United States Patent [19]

Rabban

[11] Patent Number: 4,720,879

[45] Date of Patent: Jan. 26, 1988

[54] UTILITY SINK WITH PULL-THROUGH ROLLERS

[76] Inventor: Philipp Rabban, P.O. Box 477, Hallandale, Fla. 33009

[21] Appl. No.: 44,159

[22] Filed: Apr. 30, 1987

[51] Int. Cl.[4] ..... A47K 1/04

[52] U.S. Cl. ..... 4/619; 4/628; 4/653; 4/654; 15/262

[58] Field of Search ..... 4/650, 661, 653, 654, 4/658, 628; 15/262

[56] References Cited

U.S. PATENT DOCUMENTS

| | | | |
|---|---|---|---|
| 512,795 | 1/1894 | Betts | 15/262 |
| 774,875 | 11/1904 | Halstead | 15/262 |
| 1,843,635 | 2/1932 | Taylor | 4/650 |
| 1,862,891 | 6/1932 | Fritsch | 15/262 |
| 3,074,097 | 1/1963 | Spier | 15/262 |
| 3,506,997 | 4/1970 | Coraminas | 15/262 |
| 3,921,247 | 11/1975 | Cook | 15/262 |
| 4,135,269 | 1/1979 | Marston | 15/262 |

FOREIGN PATENT DOCUMENTS

| | | | |
|---|---|---|---|
| 208984 | 1/1924 | United Kingdom | 15/262 |

*Primary Examiner*—Henry K. Artis

*Attorney, Agent, or Firm*—Stanley W. Sokolowski

[57] ABSTRACT

A utility sink with pull-through rollers is provided, having removable and repositionable compression surfaces which improve safety and efficiency in the mop wringing state of cleaning floor surfaces. A basin confines and saves cleaning liquids to soak the mops, and has snap pivot retainers that position pull-though rollers so the user's thrust may be downward or away from his body while he stands in a safe and secure stance.

4 Claims, 5 Drawing Figures

FIG. 1
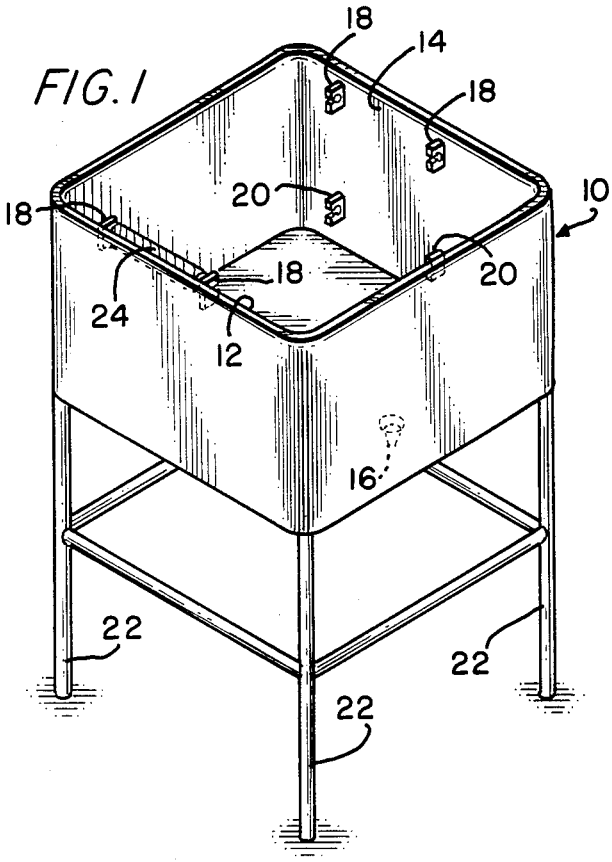
FIG. 2
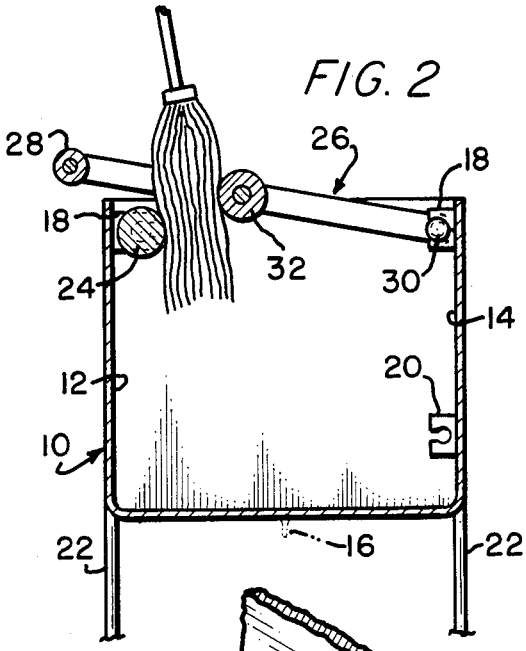
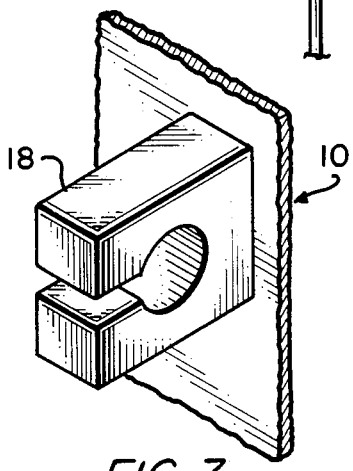
FIG. 3
FIG. 4
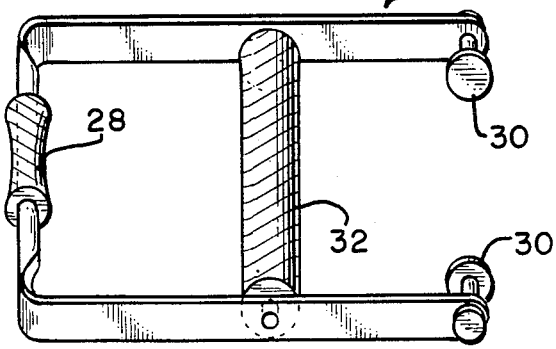
FIG. 5
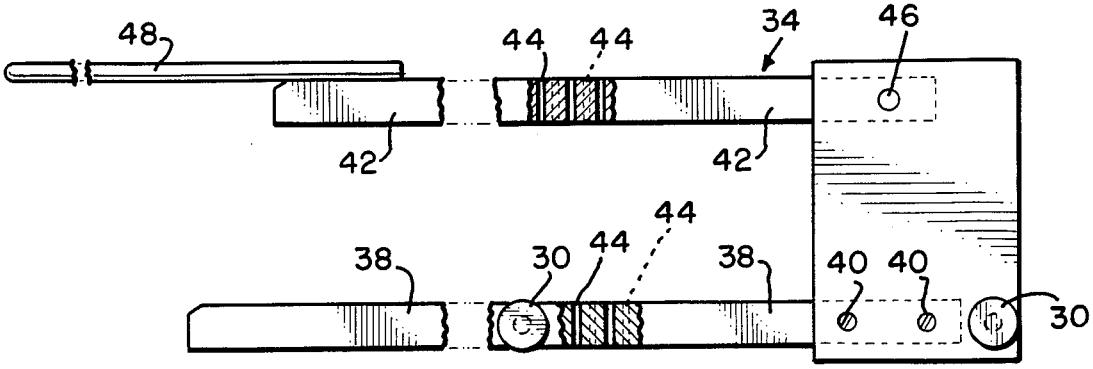

UTILITY SINK WITH PULL-THROUGH ROLLERS

BACKGROUND OF THE INVENTION

Domestic and commercial cleaning of floors and other plastic, concrete or wooden structures relies mainly on the time proven string mop, because of its economy, durability and effectiveness. Mop pails with wringers attached are awkward to use, at best, and are deceptively dangerous at worst. They require gymnastic movements by the operator to effectively wring a mop and expose the operator to injuries. Those provided with wheels for mobility are the worst, because they require the user to balance his weight with one foot on an extension to keep the pail from rolling away, while pressing down on a compressor pedal with the other foot and pulling up on the mop with the arms. Emptying a heavy pail with all this paraphernalia is tiring and injurious to a worker with less than a perfect back.

BRIEF SUMMARY OF THE INVENTION

The object of this invention is to provide a utility sink with pull through rollers that permit the user to wring his mops in a safe stance. Another object is to afford the user a choice in directing his thrust in the wringing cycle downwardly or away from him, and in either case taking mechanical advantage of his weight rather than relying on muscular exertion. Another object is to minimize the lifting of unnecessary non-water weight, in particular mechanism laden pails. Yet another object of the invention is to provide an apparatus that is easy to clean and simple to repair.

Other and further objects of this invention will become obvious upon understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

FIG. 1 is a perspective view of one embodiment of the invention.

FIG. 2 is a side elevational section of the invention.

FIG. 3 is a perspective view of a snap pivot retainer

FIG. 4 is a perspective view of a roller arm assembly.

FIG. 5 is a side elevational view and partial section of a compression board assembly.

DETAILED DESCRIPTION OF THE INVENTION

The apparatus shown in FIG. 1 uses a stainless utility sink 10 having a forward wall 12, a rear wall 14 and a drain 16. Fixedly mounted on the forward and rear walls are pairs of upper snap pivot retainers 18 and on the rear wall a pair of lower snap pivot retainers 20. The sink 10 is rigidly mounted on support legs 22 at a height from the floor sufficient to eliminate the need of bending from the waist by most operators, when rinsing or wringing a mop. One or two pairs of legs may be furnished with castors to impart mobility to the sink. A pair of upper snap pivot retainers 18 is positioned on the front wall so that a removable support roller 24 may be snap pressed into the forward wall retainers and the assembly functions as a typical axle and bushing. A roller arm assembly 26 shown in FIG. 4 having a handle 28, pivot pins 30 and compression roller 32 may be engaged with the upper snap pivot retainers 18 on the rear wall by pressing its pivot pins 30 into the bushing cavity of the retainers. Thus pivoted in position, the roller arm assembly is raised by handle 28 to provide clearance between the support roller 24 and compression roller 32 for insertion of the mop to be wrung. The operator then simply holds the handle 28 down to squeeze the rollers against the mop (as shown in FIG. 2) and leans away from the sink to effortlessly extract water from the mop and the mop from the rollers.

If the operator prefers, the roller arm assembly may be engaged with the pair of lower snap pivot retainers leaving the handle resting on the front wall of the sink in the ready position. The support roller 24 is snapped into operating position in the upper pair of retainers on the rear wall. The drill then is to drape the mop over the compression roller, raise the handle 28 in a forward arc away from the operator, and while squeezing the mop between the rollers with one arm, extracting it with a horizontal pull with the other arm.

FIG. 5 shows a variant of this invention in which a board assembly 34 may be used to squeeze the mop. It comprises a bracket 36, a fixed compression board 38, perforated with drain holes 44, rigidly attached to the bracket by screw or pin means 40. A movable compression board 42 also perforated with drain holes 44 is pivotably attached to the bracket by pivot studs 46 and provided with a leveraged extension handle 48. The bracket and fixed board have pivot pins spaced to engage a lower and upper pair of the snap pivot retainers, respectively, and when the board assembly is snapped into place, the pivotable compression board handle rests on the front edge of the sink in the ready position. The operator simply drapes the wet mop over the pivotable board, raises the handle away from him and leans on it. His weight squeezes the mop and the extracted water falls through the drain holes into the sink.

As many apparently widely different embodiments from the present invention may be made without departing from the spirit and scope thereof, it is to be understood that the invention is not limited to the specific embodiments shown except as defined in the appended claims.

What is claimed is:

1. A utility sink of generally rectangular shape, having side, forward and rear walls and a bottom surface, a drain means positioned in said bottom surface, said drain means connectable with a disposable drainage system, removable mop wringing means, fixed pivot retainers for said wringing means on said front and rear walls, a plurality of fixed legs having the same length supporting said sink in an elevated position;

said pivot retainers further comprising a base fixedly attached to a wall of the sink, parallel upper and lower projections extending from said base perpendicularly from said wall toward the opposite wall, said projections each having a plane horizontal surface in apposition with each other separated by an interplanar space of fixed dimension, a horizontal partially cylindrical bushing surface within said base axially parallel to the wall of attachment and to the bottom surface of the sink, and having a cylindrical diameter larger than said interplanar distance, wherein said bushing merges with said apposite plane surfaces;

said removable wringer means further comprising a cylindrical roller having an axle insertable in said retainers through the said interplanar spaces of said retainers, and a pivotable roller arm assembly comprising an elongate handle, two equal parallel arms projecting perpendicularly from the opposite ends of the handle, a compression roller axially supported between said arms, and snap pivot pins projecting from the distal ends of said arms toward each other along a single imaginary axis.

2. The utility sink of claim 1 wherein at least two of the plurality of fixed legs have casters affixed to the free ends thereof.

3. A utility sink of generally rectangular shape, having side, forward and rear walls and a bottom surface, a drain means positioned in said bottom surface, said drain means connectable with a disposable drainage system, removable mop wringing means, fixed pivot retainers for said wringing means on said front and rear walls, a plurality of fixed legs having the same length supporting said sink in an elevated position;

said pivot retainers further comprising a base fixedly attached to a wall of the sink, parallel upper and lower projections extending from said base perpendicularly from said wall toward the opposite wall, said projections each having a plane horizontal surface in apposition with each other separated by an interplanar space of fixed dimension, a horizontal partially cylindrical bushing surface within said base axially parallel to the wall of attachment and to the bottom surface of the sink, and having a cylindrical diameter larger than said interplanar distance, wherein said bushing merges with said apposite plane surfaces;

said removable wringer means further comprising a bracket having two ends, snap-pivot pins projecting coaxially from said two ends, a rectangular first perforated board rigidly attached at one edge to said bracket by first pin means, snap-pivot pins projecting coaxially from opposite edges of said first perforated board and coplanar with said snap-pivot pins projecting from said bracket ends, a rectangular second perforated board pivotably attached at one edge to said bracket by second pin means, and a lever handle fixedly attached to said second perforated board proximate the edge of the board distal from said bracket and projecting perpendicularly away from said bracket.

4. The utility sink of claim 3 wherein at least two of the plurality of fixed legs have casters affixed to the free ends thereof.

* * * * *

UNITED STATES PATENT AND TRADEMARK OFFICE

CERTIFICATE OF CORRECTION

PATENT NO. : 4,720,879

DATED : Jan. 26, 1988

INVENTOR(S) : PHILIPP RABBAN

It is certified that error appears in the above—identified patent and that said Letters Patent is hereby corrected as shown below:

Cover sheet, [76] Inventor: Philipp Rabban, PO Box 477
Hallandale, Fla 33009 "
should read -- "[76] Inventor: Philipp Rabban, PO Box 447,
Hallandale, FL 33009--.

Signed and Sealed this

Twenty-sixth Day of July, 1988

*Attest:*

DONALD J. QUIGG

*Attesting Officer*

*Commissioner of Patents and Trademarks*